United States Patent [19]

Iten

[11] Patent Number: 4,735,312

[45] Date of Patent: Apr. 5, 1988

[54] RAZOR PACKAGING

[75] Inventor: Clemens A. Iten, Fishersville, Va.

[73] Assignee: American Safety Razor Company, Verona, Va.

[21] Appl. No.: 86,481

[22] Filed: Aug. 18, 1987

[51] Int. Cl.[4] ..... B65D 73/00

[52] U.S. Cl. ..... 206/372; 206/349; 206/477; 206/479

[58] Field of Search ..... 206/352, 354, 208, 372, 206/349, 228, 477, 478, 479, 480, 481, 483

[56] References Cited

U.S. PATENT DOCUMENTS

| | | | |
|---|---|---|---|
| D. 253,040 | 10/1979 | Fournier et al. . | |
| D. 255,327 | 6/1980 | Samsing . | |
| D. 257,327 | 10/1980 | Samsing . | |
| D. 262,095 | 12/1981 | Takahaski . | |
| D. 272,803 | 2/1984 | Richards . | |
| D. 275,737 | 10/1984 | Carey, Jr. et al. . | |
| D. 276,793 | 12/1984 | Richards . | |
| D. 276,893 | 12/1984 | Richards . | |
| 1,877,840 | 9/1932 | Frowenfeld | 206/479 |
| 2,535,229 | 12/1950 | Paolantonio | 206/479 X |
| 2,594,093 | 4/1952 | Thompson . | |
| 2,825,162 | 3/1958 | Flood . | |
| 2,884,150 | 4/1959 | Weichselbaum et al. . | |
| 3,464,545 | 9/1969 | Bailey | 206/478 |
| 3,802,987 | 4/1974 | Noll . | |
| 3,917,120 | 11/1975 | Larenz et al. . | |
| 4,000,832 | 1/1977 | Pentney . | |
| 4,024,950 | 5/1977 | Werth . | |
| 4,128,172 | 12/1978 | Joyce . | |
| 4,140,244 | 2/1979 | Clabby | 206/228 X |
| 4,266,664 | 5/1981 | Dixon et al. . | |
| 4,322,002 | 3/1982 | Iten . | |
| 4,432,452 | 2/1984 | Kelly . | |
| 4,445,610 | 5/1984 | Richards . | |
| 4,496,047 | 1/1985 | Gatley . | |
| 4,555,030 | 11/1985 | Byrne et al. . | |
| 4,564,108 | 1/1986 | Widlund et al. . | |
| 4,601,392 | 7/1986 | Althaus . | |
| 4,637,060 | 1/1987 | Ausnit . | |
| 4,664,733 | 5/1987 | Masago . | |

FOREIGN PATENT DOCUMENTS

| | | | |
|---|---|---|---|
| 1111366 | 10/1955 | France | 206/372 |
| 299089 | 7/1932 | Italy | 206/479 |
| 398729 | 9/1933 | United Kingdom | 206/479 |
| 543036 | 2/1942 | United Kingdom | 206/479 |

*Primary Examiner*—William Price

*Attorney, Agent, or Firm*—Nixon & Vanderhye

[57] ABSTRACT

Razor packaging includes a plurality of razors having handles and heads nested in front-to-back relation adjacent one another, with threads being disposed over the top and bottom portions of the razor heads on opposite sides thereof and looped one with the other to preclude displacement of the razors relative to one another. The last razor is secured to a tag by stitching the threads extending from the group of razors into the tag. An aperture is provided in the tag such that the razor package can be disposed on a hook for hanging from a displayboard. In this manner, groups of razors are precluded from disconnection one with the other absent severing the threads by the ultimate end user.

19 Claims, 1 Drawing Sheet

RAZOR PACKAGING

BACKGROUND AND SUMMARY OF THE INVENTION

The present invention relates to packaging for razors and particularly relates to razor packaging wherein razors can be readily, easily and inexpensively maintained in a coherent group thereof for purposes of retail display.

Various types of packaging for razors have been proposed and constructed in the past. Because of the unique shape and configuration of razors, i.e., an elongated handle having an angled portion for connection to a razor head extending in a direction normal to the handle, packaging of razors has taken various forms. For example, in U.S. Pat. No. Des. 272,803, there is disclosed a box-like assembly having an elongated slot. The heads of the razors are disposed in the box and the handles extend through the slot to depend from the box. In U.S. Pat. No. 4,601,392, there is provided a support plate for supporting the ends of the razor heads, by means of a strip integrally molded with the protective caps for the razor heads. Various other types of packaging for razors have been proposed. However, the unique shape of the razor presents particular problems in efforts to provide inexpensive packaging for razors which is readily and easily adapted for display in standard display racks.

According to the present invention, there is provided a unique packaging for razors whereby the razors can be readily, easily and inexpensively attached or secured one to the other and to a display tag in such manner that the razors are adapted for display from standard display racks as a coherent group thereof and which razors may not be separated one from the other or from the display tag absent cutting or otherwise severing the means securing the razors and tag each to the other. Thus, the razor package of the present invention may be displayed, for example, by attaching the tag to a hook on a standard display board with the plurality of razors attached to the tag dependent therefrom. The razors may be readily handled yet they are not separable one from the other or from the tag.

Additionally, each razor is normally provided with a protective cap over its head which is readily removable when the razor is to be used. In razor packaging, a problem sometimes arises because the cap may be inadvertently removed from the razor thereby exposing the razor blade and raising the potential for injury. For example, loose packaging of the razors may permit the caps to be knocked loose. The present invention provides the razor package in such manner that each cap is maintained in position secured on the razor head and is prevented from inadvertent removal from the head until the user separates the razors for ultimate use.

Accordingly, and in accordance with one aspect of the present invention, there is provided razor packaging comprising a plurality of razors, each of which has a razor head and a handle projecting from the head, a display tag, and means for connecting the razors one to the other and to the tag, including a thread stitched through the tag and disposed about the razor heads. Preferably, the razor heads are serially connected one to the other by the thread. The tag is attached to an end razor in the serially arranged razors by a continuation of the thread, which is stitched through the tag.

Preferably, two threads are stitched through the tag at laterally spaced positions therealong. Each thread extends over a first or upper side of the razor heads (opposite from the handle) and a second thread portion extends along the underside of the razor heads. The first thread portion is looped about the second thread portion, whereby the first thread portion extends along the upper sides of the razor heads and the second thread portion extends along the lower sides thereof with the looped portion of each thread disposed between each of the adjacent razor heads. In this manner, the razor heads are captured by the thread portions between the looped portions. In so doing, the caps are also maintained in securement on the razor heads. It will also be appreciated that the tag may be printed with indicia identifying the manufacturer and the features of the razors and also that a plurality of razors may be readily and easily attached to the tag by a stitching operation.

Accordingly, it is a primary object of the present invention to provide novel and improved razor packaging which is readily, easily and inexpensively constructed to maintain a plurality of razors in a coherent group, readily adapted for display purposes and which minimizes or eliminates the potential for inadvertent removal of the cap from the razor head.

These and further objects and advantages of the present invention will become more apparent upon reference to the following specification, appended drawings and claims.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
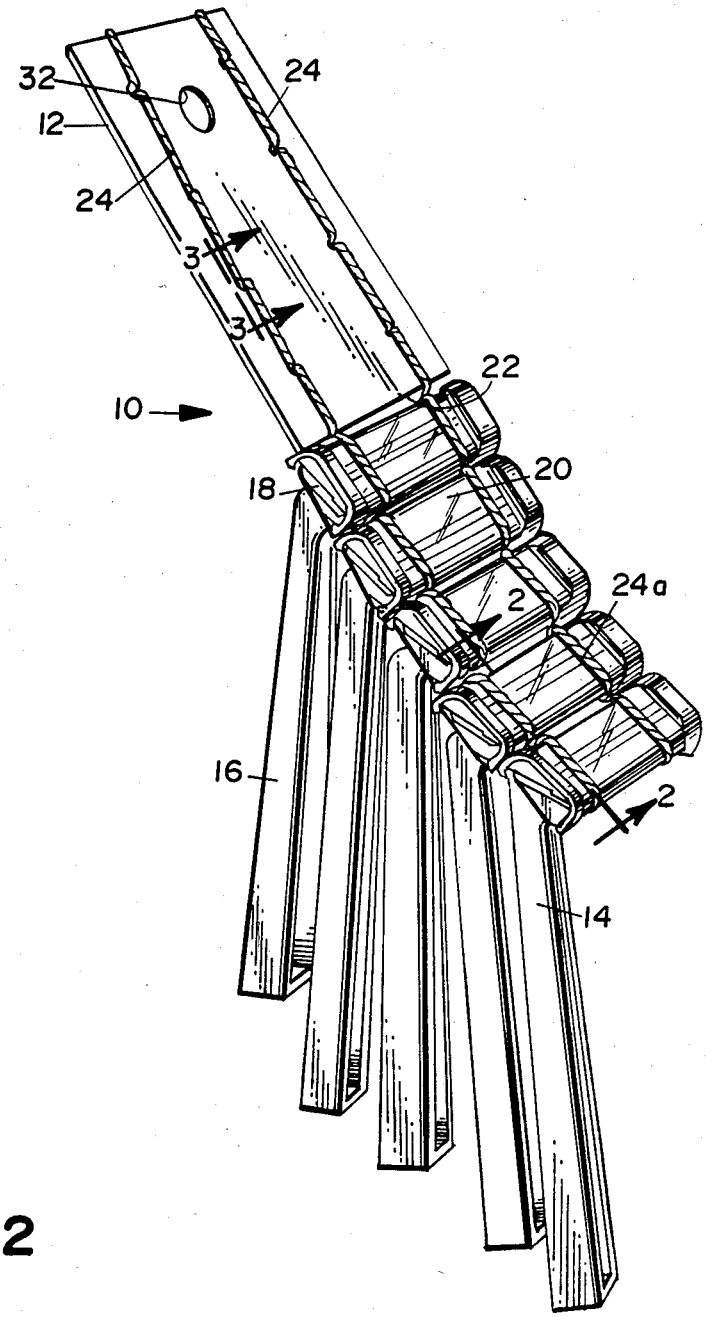
FIG. 1 is a perspective view of a razor package constructed in accordance with the present invention.
Figure 2:
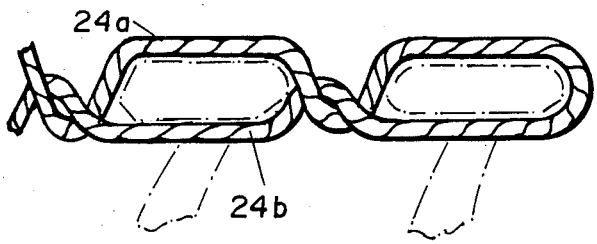
FIG. 2 is an enlarged fragmentary cross-sectional view thereof taken generally about on line 2—2 in FIG. 1.

Referring now to the drawings, particularly to FIG. 1, there is illustrated razor packaging constructed in accordance with the present invention and generally designated 10. Packaging 10 comprises a tag 12 and a plurality of razors 14 secured to tag 12. As illustrated in FIG. 1, each razor 14 has a handle 16 and a razor head 18 with a generally channel-shaped cap 20 overlying the head covering the blade or blades of the razor head 18. It will be appreciated that the construction of the razors, including their handles, heads and caps, is conventional and per se forms no part of the present invention. Suffice to say, however, that the shape of the handles and heads are complementary such that when aligned in the razor packaging hereof, the handles and heads nest against one another.

Figure 3:
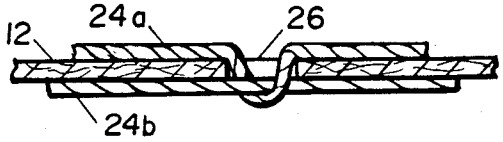
FIG. 3 is an enlarged fragmentary cross-sectional view thereof taken about on line 3—3 in FIG. 1 and illustrating the stitching through the tag.

In accordance with the present invention, the razors are serially aligned one with the other in the nesting relation substantially as illustrated in FIG. 1 with the uppermost razor, as illustrated, being connected to tag 12 along its lowermost discrete edge 22. Razors 14 are joined one to the other in serial relation by a pair of threads 24. Threads 24 join adjacent razor heads one to the other along each of the upper and lower surfaces thereof along opposite sides of the razor heads from handle 14. Each thread 24 is stitched to tag 12 and, as illustrated in FIG. 3, has upper and lower thread portions 24*a* and 24*b*, respectively. Thus, for example, in tag 12, the upper thread portion 24 is disposed through an aperture 26 in tag 12 and looped about lower thread portion 24*b* to reemerge through the aperture 26 and extend along the upper face of tag 12. This type of stitching is, of course, repeated throughout the length of tag 12. The distal ends of the threads lie at the upper end of tag 12.

Threads 24 are disposed about razor heads 18 and caps 20 thereon in similar fashion. Particularly, the upper portion 24*a* of each thread 24 extends between each adjacent pair of razor heads 18 and is looped about the corresponding lower thread portion 24*b*. The looped portion then reemerges between the same adjacent pair of razor heads 18 for extension over the cap 20 on the next razor head. Looping of the thread portions is then repeated between the next adjacent pair of razor heads. At the last of the razor heads, the lowermost one illustrated in FIG. 1, each upper thread portion 24*a* extends around its distal edge and becomes the lower thread portions 24*b*.

By stitching the two threads to tag 12 and extending thread portions 24*a* and 24*b* around the razor heads on each of the opposite sides of handles 16, not only is displacement of the razor heads away from one another precluded, but lateral displacement of the razors relative to one another is also precluded. That is to say, because of the looping action of the upper and lower thread portions and about the razor heads on opposite sides of the handle, the razor heads, including caps 20, are precluded from endwise lateral displacement relative to one another.

It will be appreciated that suitable indicia may be placed on tag 12. As illustrated, an aperture 32 is formed adjacent the upper end of tag 12 whereby the tag may be disposed on a hook, for example, on a standard display board, with the razors depending therefrom. The tag is preferably formed of paperboard, although other material, such as plastic, may be used as desired. Also, conventional thread, either natural or synthetic fibers, may be used to form the threads 24.

Consequently, it will be appreciated that the objects of the present invention are fully accomplished in that there has been provided novel and improved packaging for razors in a manner to facilitate their display, as well as to maintain plural razors in an integral coherent group, i.e., as a single entity or unit, which may not be disassembled without cutting the threads. Also, the protective caps on the razor heads are maintained in place by the threads in their position secured on the razor heads.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Razor packaging comprising:

a plurality of razors, each of said razors having a razor head and a handle projecting from the head;

a display tag; and means for connecting said razors one to the other and to said tag including a thread stitched through said tag and disposed about said razor heads.

2. Packaging according to claim 1 wherein said razor heads are serially connected one to the other by said thread.

3. Packaging according to claim 1 wherein each of said razor heads has a length greater than its width, said razor heads being serially connected one to the other by said thread with the long sides of adjacent razor heads adjoining one another.

4. Packaging according to claim 1 wherein said tag has a discrete edge, said razors being connected to said tag along said discrete edge thereof.

5. Packaging according to claim 4 wherein said razor heads are serially connected one to the other by said thread.

6. Packaging according to claim 4 wherein each of said razor heads has a length greater than its width, said razor heads being serially connected one to the other by said thread with the long sides of adjacent razor heads adjoining one another.

7. Packaging according to claim 1 including a second thread stitched to said tag and disposed about said razor heads for connecting said razors one to the other and to said tag, said razor heads being elongated with said handles projecting from said heads at locations substantially medially of the lengths thereof, the threads being disposed about each said razor head on opposite sides thereof relative to said handle.

8. Packaging according to claim 7 wherein each of said razor heads has a length greater than its width, said razor heads being serially connected one to the other by said threads with the long sides of adjacent razor heads adjoining one another.

9. Packaging according to claim 8 wherein said tag has a discrete edge, said razors being connected to said tag along said discrete edge thereof.

10. Packaging according to claim 1 wherein each of said razor heads has a protective cap mounted thereon, said thread being disposed about each said razor head including said cap to maintain said cap on said razor head.

11. Packaging according to claim 9 wherein each of said razor heads has a protective cap mounted thereon, said threads being disposed about each said razor head including said cap to maintain said cap on said razor head.

12. Packaging according to claim 1 wherein said thread constitutes solely a single thread having its opposite ends lying adjacent said tag, said razor heads being serially connected one to the other by said thread, said thread having a first thread portion extending from said tag over a first side of said razor heads and a second thread portion extending along a second side of said razor heads, said first thread portion being looped about said second thread portion at locations between each adjoining head for return to extend over the first side of the next serially adjoined razor head.

13. Packaging according to claim 12 wherein each of said razor heads has a protective cap mounted thereon, said thread being disposed about each said razor head including said cap to maintain said cap on said razor head.

14. Packaging according to claim 1 including a second thread stitched to said tag and disposed about said razor heads to connect said razors one to the other and to said tag, said razor heads being elongated with said handles projecting from said heads at a location substantially medially of the length thereof, the threads being disposed about each said razor head on opposite sides thereof relative to said handle, each said thread constituting solely a single thread having its opposite ends lying adjacent said tag, said razor heads being serially connected one to the other by said threads, each said thread having a first thread portion extending from said tag over a first side of said razor heads and a second thread portion extending along a second side of said razor heads, each said first thread portion being looped about the associated second thread portion at locations between each adjoining head for return to extend over the first side of the next serially adjoined razor head.

15. Packaging according to claim 14 wherein said tag has a discrete edge, said razors being connected to said tag along said discrete edge thereof, said tag being formed at least in part of paperboard.

16. Razor packaging comprising:

a plurality of razors, each of said razors having a razor head and a handle projecting from the head;

a display tag having a discrete edge; and means for serially connecting said razors one to the other and to said tag along said discrete tag edge.

17. Packaging according to claim 1 wherein each of said razor heads has a length greater than its width, said razor heads being connected serially one to the other with the long sides of adjacent razor heads adjoining one another.

18. Packaging according to claim 17 wherein said razor heads are elongated with said handles projecting from said heads at a location substantially medially of the length thereof, said connecting means connecting each said razor head on opposite sides thereof relative to said handle.

19. Packaging according to claim 17 wherein each of said razor heads has a protective cap mounted thereon, said connecting means being disposed on each said razor head to maintain said cap on said razor head.

* * * * *